US007023194B1

(12) United States Patent
Sutardja et al.

(10) Patent No.: US 7,023,194 B1
(45) **Date of Patent: *Apr. 4, 2006**

(54) LOW POWER AND HIGH ACCURACY BAND GAP VOLTAGE REFERENCE CIRCUIT

(75) Inventors: Sehat Sutardja, Los Altos Hills, CA (US); Jiancheng Zhang, Los Altos Hills, CA (US)

(73) Assignee: Marvell International Ltd., Hamilton (BM)

( * ) Notice: Subject to any disclaimer, the term of this patent is extended or adjusted under 35 U.S.C. 154(b) by 0 days.

This patent is subject to a terminal disclaimer.

(21) Appl. No.: 10/926,185

(22) Filed: Aug. 25, 2004

Related U.S. Application Data

(63) Continuation of application No. 10/413,927, filed on Apr. 15, 2003, now Pat. No. 6,844,711.

(51) Int. Cl.
*G05F 3/16* (2006.01)

(52) U.S. Cl. ..... 323/314; 323/313; 323/316

(58) Field of Classification Search ..... 323/312–316, 323/272, 280; 307/297, 296, 455, 355, 491, 307/356; 327/530–540

See application file for complete search history.

(56) References Cited

U.S. PATENT DOCUMENTS

| | | | |
|---|---|---|---|
| 4,059,793 | A | 11/1977 | Ahmed |
| 4,896,094 | A | 1/1990 | Greaves et al. |
| 5,642,037 | A | 6/1997 | Malherbe |
| 5,703,475 | A | 12/1997 | Lee et al. |
| 5,949,227 | A | 9/1999 | Bujanos |
| 5,955,873 | A | 9/1999 | Maccarrone et al. |
| 6,124,704 | A | 9/2000 | Annema |
| 6,150,871 | A | 11/2000 | Yee |
| 6,204,653 | B1 | 3/2001 | Wouters et al. |
| 6,335,614 | B1 | 1/2002 | Ganti |
| 6,346,802 | B1 | 2/2002 | Lasalandra et al. |
| 6,441,595 | B1 | 8/2002 | Pelissier et al. |
| 6,765,431 | B1 | 7/2004 | Coady |

FOREIGN PATENT DOCUMENTS

| | | | |
|---|---|---|---|
| GB | 2218544 | A | 11/1989 |

*Primary Examiner*—Rajnikant B. Patel

(57) ABSTRACT

A band gap voltage reference circuit includes a high accuracy band gap (BG) circuit that generates a BG voltage potential $V_{bgH}$. A low accuracy BG circuit includes a variable resistance and outputs a BG voltage potential $V_{bgL}$ that is related to a value of the variable resistance. A calibration circuit communicates with the high and low accuracy BG circuits, adjusts the variable resistance based on a difference between the BG voltage potential $V_{bgH}$ and the BG voltage potential $V_{bgL}$, and shuts down the high accuracy BG circuit when the BG voltage potential $V_{bgL}$ is approximately equal to the BG voltage potential $V_{bgH}$.

96 Claims, 9 Drawing Sheets

LOW POWER AND HIGH ACCURACY BAND GAP VOLTAGE REFERENCE CIRCUIT

CROSS-REFERENCE TO RELATED APPLICATIONS

This application is a continuation of U.S. patent application Ser. No. 10/413,927, filed Apr. 15, 2003 now U.S. Pat No. 6,844,711. The disclosure of the above application is incorporated herein by reference.

FIELD OF THE INVENTION

The present invention relates to voltage reference circuits, and more particularly to band gap voltage reference circuits having high accuracy and low power consumption.

BACKGROUND OF THE INVENTION

Band gap (BG) voltage reference circuits provide a fixed voltage reference for integrated circuits. Referring now to FIG. 1, an exemplary BG circuit 10 is shown and includes transistors $Q_1$ and $Q_2$, resistances $R_1$, $R_2$, and $R_3$, a variable resistance $R_{var}$ and an amplifier A. Collectors and bases of the transistors $Q_1$ and $Q_2$ are connected to a potential such as ground. The resistance $R_3$ has one end that is connected to an emitter of the transistor $Q_1$ and another end (at potential $V_1$) that is connected to the resistance $R_1$ and an inverting input of the amplifier A. The resistance $R_1$ is connected between one end of the resistance $R_{var}$ and one end of the resistance $R_2$. Another end of the resistance $R_2$ (at potential $V_2$) is connected to the emitter of the transistor $Q_2$ and a non-inverting input of the amplifier A. An output of the amplifier A is connected to another end of the resistance $R_{var}$, which is at the BG voltage potential $V_{bg}$.

Junctions between the emitters and the bases of the transistors $Q_1$ and $Q_2$ operate as diodes. The emitter area of $Q_1$ is typically larger than the emitter area of $Q_2$, where K is a ratio of the emitter area of $Q_1$ divided by the emitter area of $Q_2$. Amplifier A forces the voltage potentials $V_1=V_2$. Since the resistances $R_1=R_2$, the current flowing into the transistor $Q_1$ is equal to the current flowing into the transistor $Q_2$. Therefore, $$\Delta V_{be}=|V_{be}(Q_2)-|V_{be}(Q_1)|V_T 1n(K)$$

$$V_{bg}=V(R_{var})+V(R_2)+|V_{be}(Q_2)|$$

$\Delta V_{be}$ is applied across the resistance $R_3$ to establish a proportional to absolute temperature (PTAT) voltage. The voltages $V(R_{var})$ and $V(R_2)$ have positive temperature coefficients. $|V_{be}(Q_2)|$ has a negative temperature coefficient. Therefore, $V_{bg}$ has a net temperature coefficient of approximately zero. The resistor $R_{var}$ is adjusted to change $V_{bg}$ and its temperature coefficient.

The accuracy of $V_{bg}$ is related to the emitter area ratio K and the emitter area. Generally as the emitter area and the emitter area ratio K increases, the accuracy of the BG circuit also increases. As used herein, the term accuracy is used to reflect the variations that occur due to process. Higher accuracy refers to increasing invariance to process. Lower accuracy refers to increasing variance to process.

While increasing accuracy, the power dissipation of the transistor also increases with the area of the emitter. Therefore, the increased precision of the BG circuit is accompanied by an increase in power dissipation. Therefore, circuit designers must tradeoff accuracy and power dissipation.

SUMMARY OF THE INVENTION

A band gap voltage reference circuit includes a high accuracy band gap (BG) circuit that generates a BG voltage potential $V_{bgH}$. A low accuracy BG circuit includes a variable resistance and outputs a BG voltage potential $V_{bgL}$ that is related to a value of the variable resistance. A calibration circuit communicates with the high and low accuracy BG circuits, adjusts the variable resistance based on a difference between the BG voltage potential $V_{bgH}$ and the BG voltage potential $V_{bgL}$, and shuts down the high accuracy BG circuit when the BG voltage potential $V_{bgL}$ is approximately equal to the BG voltage potential $V_{bgH}$.

In other features, the high accuracy BG circuit is biased by a first current level and the low accuracy BG circuit is biased by a second current level. The first current level is greater than the second current level. The calibration circuit generates a calibration signal that is used to adjust the BG voltage potential $V_{bgL}$. The calibration circuit includes a comparing circuit that compares the BG voltage potential $V_{bgH}$ to the BG voltage potential $V_{bgL}$.

A band gap voltage reference circuit includes a high accuracy band gap (BG) circuit that generates a BG voltage potential $V_{bgH}$. A low accuracy BG circuit generates a BG voltage potential $V_{bgL}$. A calibration circuit communicates with the high and low accuracy BG circuits and adjusts the BG voltage potential $V_{bgL}$ based on the BG voltage potential $V_{bgH}$.

In other features, the first BG circuit is biased by a first current level and the second BG circuit is biased by a second current level. The first current level is greater than the second current level. The calibration circuit sets the BG voltage potential $V_{bgL}$ approximately equal to the BG voltage potential $V_{bgH}$. The calibration circuit shuts down the high accuracy BG circuit when the BG voltage potential $V_{bgL}$ is approximately equal to the BG voltage potential $V_{bgH}$. The calibration circuit generates a calibration signal that is used to adjust the BG voltage potential $V_{bgL}$.

In still other features, the low accuracy BG circuit includes an adjustment circuit that receives the calibration signal and that adjusts the BG voltage potential $V_{bgL}$. The calibration circuit includes a comparing circuit that compares the BG voltage potential $V_{bgH}$ to the BG voltage potential $V_{bgL}$. The adjustment circuit includes a variable resistance.

A band gap voltage reference circuit includes a high accuracy band gap (BG) circuit that generates a BG voltage potential $V_{bgH}$. A low accuracy BG circuit outputs a BG voltage potential $V_{bgL}$. A device communicates with the high and low accuracy BG circuits and includes a high accuracy circuit and a low accuracy circuit. The device operates at least one of the high accuracy circuit and the low accuracy circuit in a high accuracy mode. The device operates the low accuracy circuit in a low accuracy mode. The device generates a mode signal based on the high accuracy mode and the low accuracy mode. The high accuracy BG circuit turns off when the mode signal corresponds to the low accuracy mode.

In other features, the low accuracy BG circuit includes a variable resistance. The BG voltage potential $V_{bgL}$ is adjusted by the variable resistance. A calibration circuit communicates with the high and low accuracy BG circuits, adjusts the variable resistance based on a difference between the BG voltage potential $V_{bgH}$ and the BG voltage potential $V_{bgL}$, and shuts down the high accuracy BG circuit when the BG voltage potential $V_{bgL}$ is approximately equal to the BG voltage potential $V_{bgH}$.

In still other features, the first BG circuit is biased by a first current level and the second BG circuit is biased by a second current level. The first current level is greater than the second current level. A summer communicates with the high and low accuracy BG circuits, sums the BG voltage potential $V_{bgL}$ and the BG voltage potential $V_{bgH}$, and outputs the sum to the device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
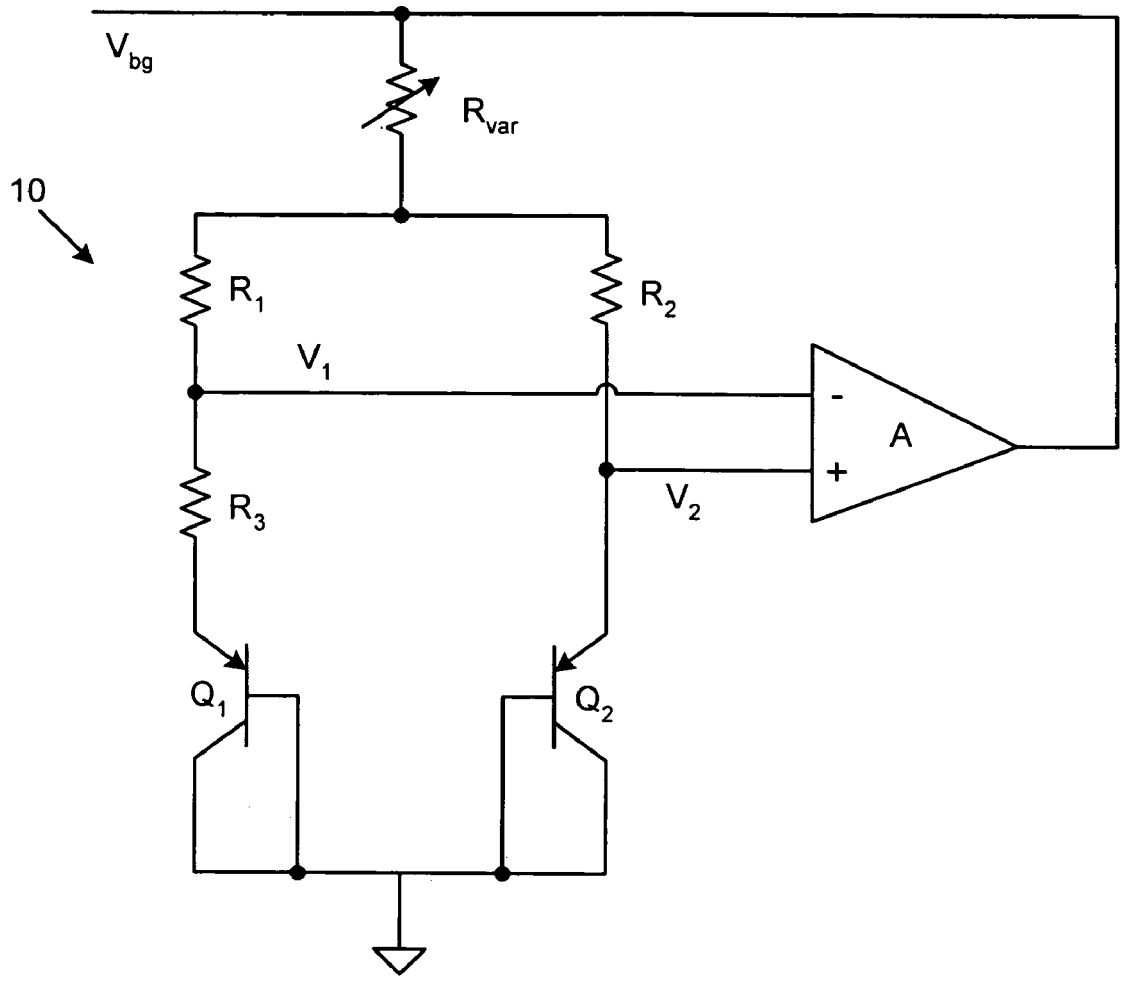
FIG. 1 illustrates an exemplary BG circuit according to the prior art.

The following description of the preferred embodiment(s) is merely exemplary in nature and is in no way intended to limit the invention, its application, or uses. For purposes of clarity, the same reference numbers will be used in the drawings to identify similar elements.

Figure 2:
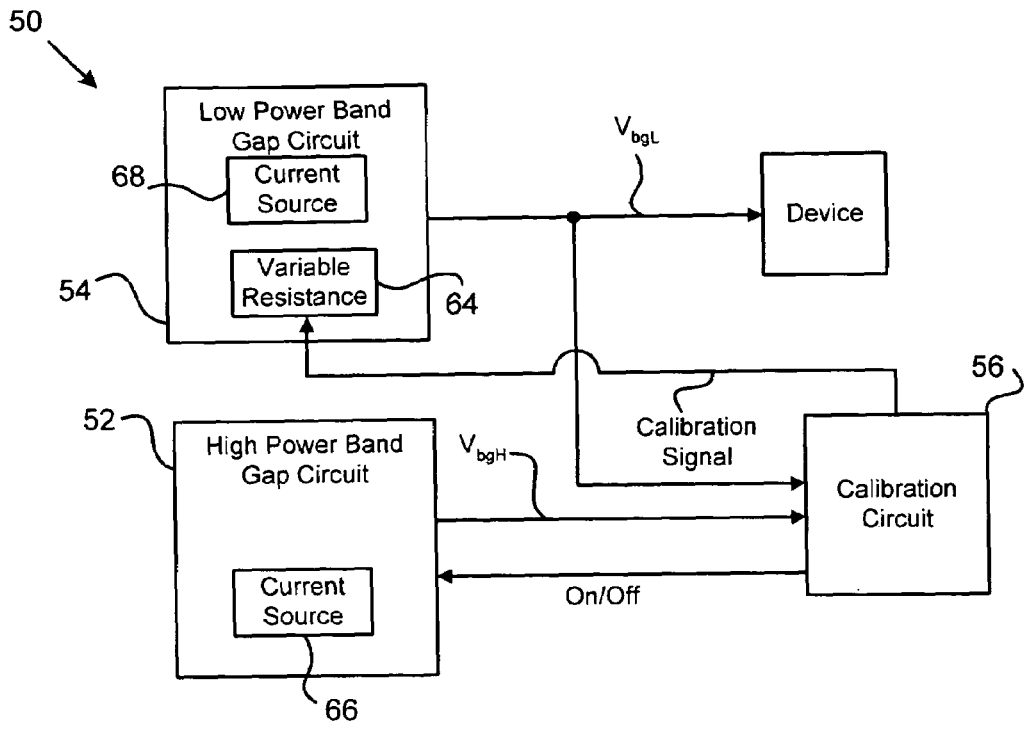
FIG. 2 is a functional block diagram of a BG circuit including low power and high power BG circuits according to the present invention.

Referring now to FIG. 2, a BG circuit 50 according to the present invention includes a high power BG circuit 52, a low power BG circuit 54, and a calibration circuit 56. As used herein, the terms high and low power are relative terms relating to the emitter area ratio K and the current density of the devices. The high power BG circuit has a larger emitter area and emitter area ratio, higher power dissipation and greater accuracy than the low power BG circuit. The degree to which the high and low power BG circuits differ will depend upon the accuracy and power consumption that is desired for a particular application. The high power BG circuit 52 provides a BG voltage reference potential $V_{bgH}$. The low power BG circuit 54 provides a BG voltage reference potential $V_{bgL}$.

The BG voltage potential $V_{bgL}$ and the BG voltage potential $V_{bgH}$ are input to the calibration circuit 56. The calibration circuit 56 compares the BG voltage potential $V_{bgL}$ to the BG voltage potential $V_{bgH}$ and generates a calibration signal. The calibration signal 62 is fed back to the low power BG circuit 54 to adjust the BG voltage potential $V_{bgL}$. In other words, the higher accuracy of the BG voltage potential $V_{bgH}$ is used to increase the accuracy of the BG voltage potential $V_{bgL}$.

In one embodiment, the calibration signal is used to adjust a variable resistance 64, which alters the BG voltage potential $V_{bgL}$, although other methods may be used. When the BG voltage potential $V_{bgL}$ and the BG voltage potential $V_{bgH}$ are approximately equal, the calibration circuit 56 turns the high power BG circuit 52 off to reduce power consumption.

In general, the current density for bipolar transistors in the high power and low power BG circuits 52 and 54, respectively, is approximately the same. The emitter area ratio of the bias current level for the high power and low power BG circuits 52 and 54 is approximately equal to the emitter area ratio of the emitter areas for the high power and low power BG circuits 52 and 54. For example, the ratio can be a factor of 4 or larger. Therefore, the high power BG circuit 52 uses bipolar transistors having larger emitter areas that are biased at a higher current levels than the low power BG circuit 54. As a result, the high power BG circuit 52 provides the BG voltage reference $V_{bgH}$ that is generally more accurate than the BG voltage potential $V_{bgL}$ that is provided by the low power BG circuit 54.

Figure 3A:
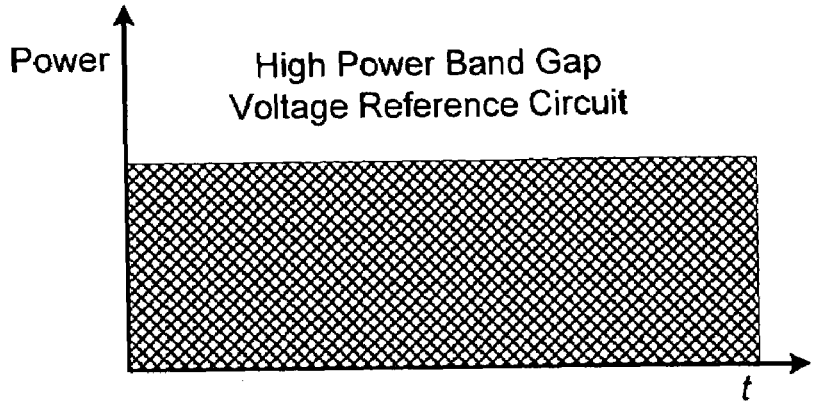
FIG. 3A Prior Art
FIG. 3A illustrates power consumption of a high power BG circuit according to the prior art.
Figure 3B:
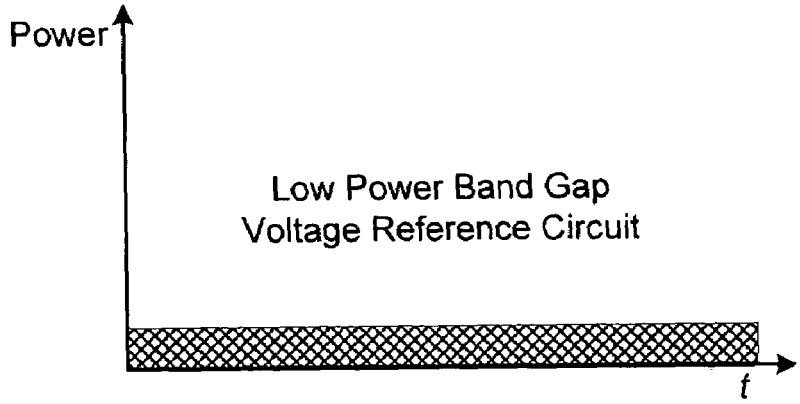
FIG. 3B Prior Art
FIG. 3B illustrates the power consumption of a low power BG circuit according to the prior art.

Referring now to FIG. 3A, power consumption of a high power BG circuit according to the prior art is shown. The high power BG circuit is biased by a higher current level. For example, a bias current level of 60 μA is output to the high power BG circuit. Conversely, a low power BG circuit is biased by a lower current level and has lower power dissipation as shown in FIG. 3B. For example, a bias current level of 10 μA may be used.

Figure 3C:
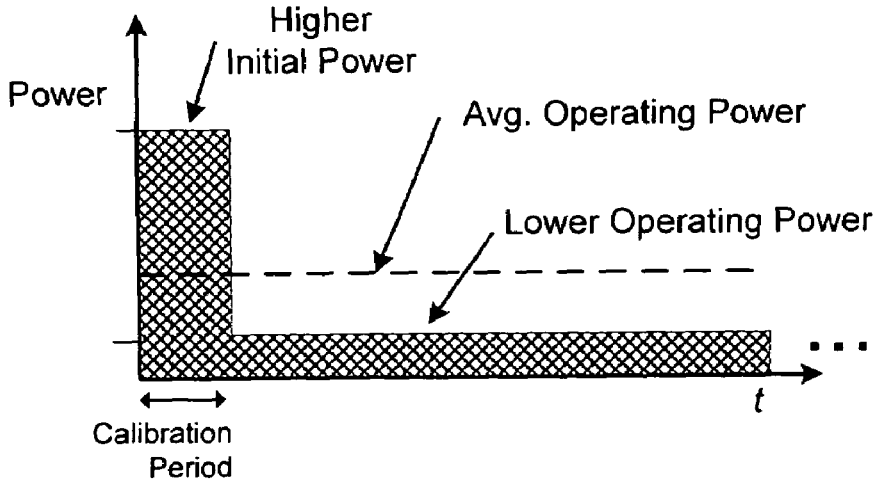
FIG. 3C illustrates the power consumption of a BG circuit with power on calibration of the low power BG circuit according to the present invention.

The power consumption of the BG circuit 50 of FIG. 2 is shown in FIG. 3C. Initially, the high power BG circuit 52 is biased by the higher current level. The low power BG circuit 54 is biased by the lower current level. This results in a higher initial power consumption. After the calibration is completed, however, the calibration circuit 56 shuts off the high power BG circuit 52. This is represented by the reduction in power consumption at the end of the calibration period in FIG. 3C. With the high power BG circuit 52 shut off, only the low power BG circuit 54 continues to consume power. As a result, the average power consumption is reduced.

Figure 3D:
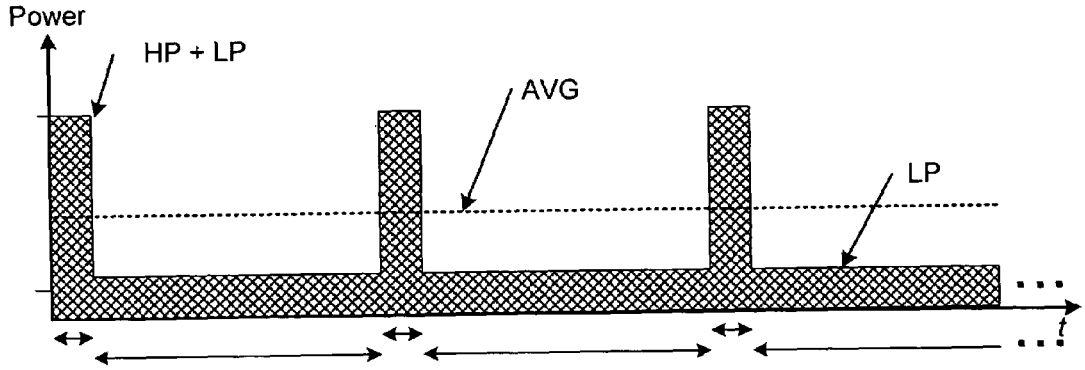
FIG. 3D illustrates the power consumption of a BG circuit with periodic calibration of the low power BG circuit according to the present invention.
Figure 3E:
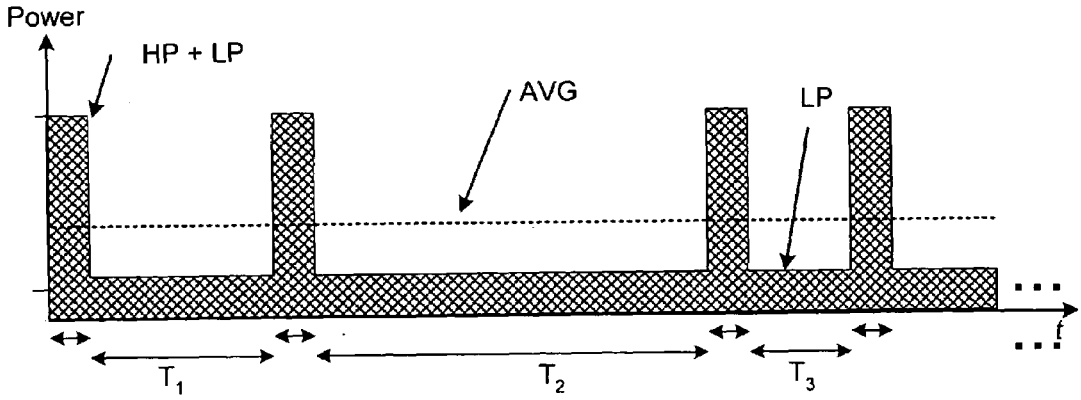
FIG. 3E illustrates the power consumption of a BG circuit with non-periodic calibration of the low power BG circuit according to the present invention.

Referring now to FIG. 3D, periodic calibration can also be performed. The calibration of the BG voltage potential $V_{bgL}$ using the BG voltage potential $V_{bgH}$ is performed after a predetermined period. Referring now to FIG. 3E, calibration can also be performed on a non-periodic basis. For example, the calibration can be performed at power on and when a predetermined event occurs. One example event could be a detected change in the BG voltage potential $V_{bgL}$. Degradation in performance of the device could also be a basis for non-periodic calibration. As another example, calibration can also occur when the operating temperature changes. Still other types of events are contemplated.

Figure 4:
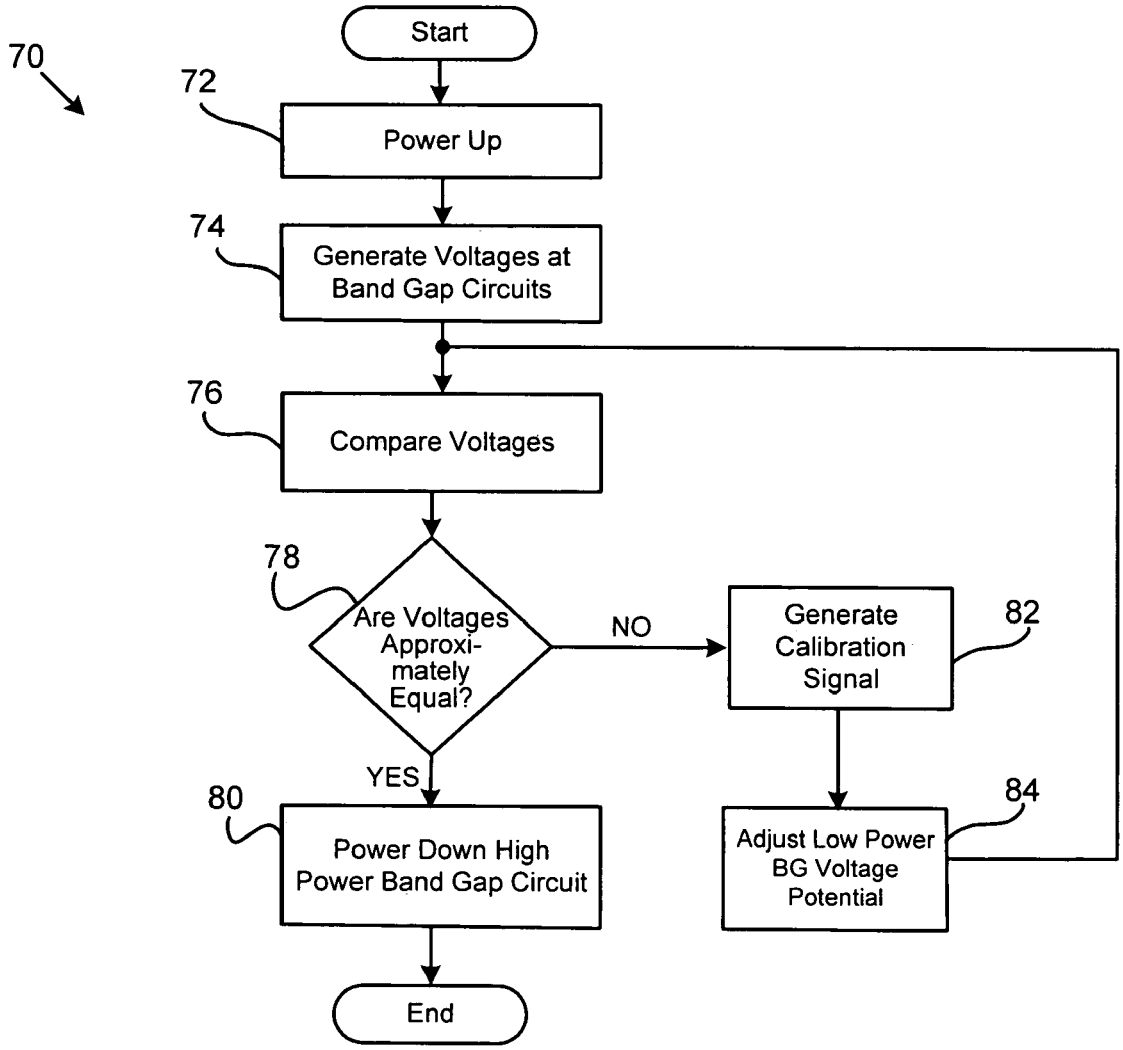
FIG. 4 is a flow diagram illustrating steps that are performed by a calibration circuit according to the present invention.

Referring now to FIG. 4, steps 70 for calibrating the low power BG circuit in FIG. 2 are shown. In step 72, both BG circuits 52 and 54 receive power at the beginning of calibration. Calibration may occur at an initial power up 72, at regular intervals, after specific events, or in any other circumstances. The foregoing description will describe calibration at start-up. However, skilled artisans will appreciate that the present invention is not limited to start-up.

After power up in step 72, the high power and low power BG circuits 52 and 54 generate the BG voltage potential $V_{bgH}$ and the BG voltage potential $V_{bgL}$, respectively, in step 74. The calibration circuit 56 compares the BG voltage potential $V_{bgH}$ to the BG voltage potential $V_{bgL}$ in step 76. In step 78, the calibration circuit 56 determines whether the BG voltage potential $V_{bgL}$ is within a predetermined threshold of the BG voltage potential $V_{bgH}$. If step 78 is true, the high power BG circuit 52 is powered down in step 80.

If the BG voltage potential $V_{bgL}$ is not within the predetermined threshold, the calibration circuit 56 generates a calibration signal in step 82. The low power BG circuit 54 receives the calibration signal in step 84 and adjusts the BG voltage potential $V_{bgL}$ based on the calibration signal. If the adjustment brings the BG voltage potential $V_{bgL}$ within the predetermined threshold, the high power BG circuit 52 powers down in step 80. Otherwise, the calibration 70 continues with steps 82 and 84.

Figure 5:
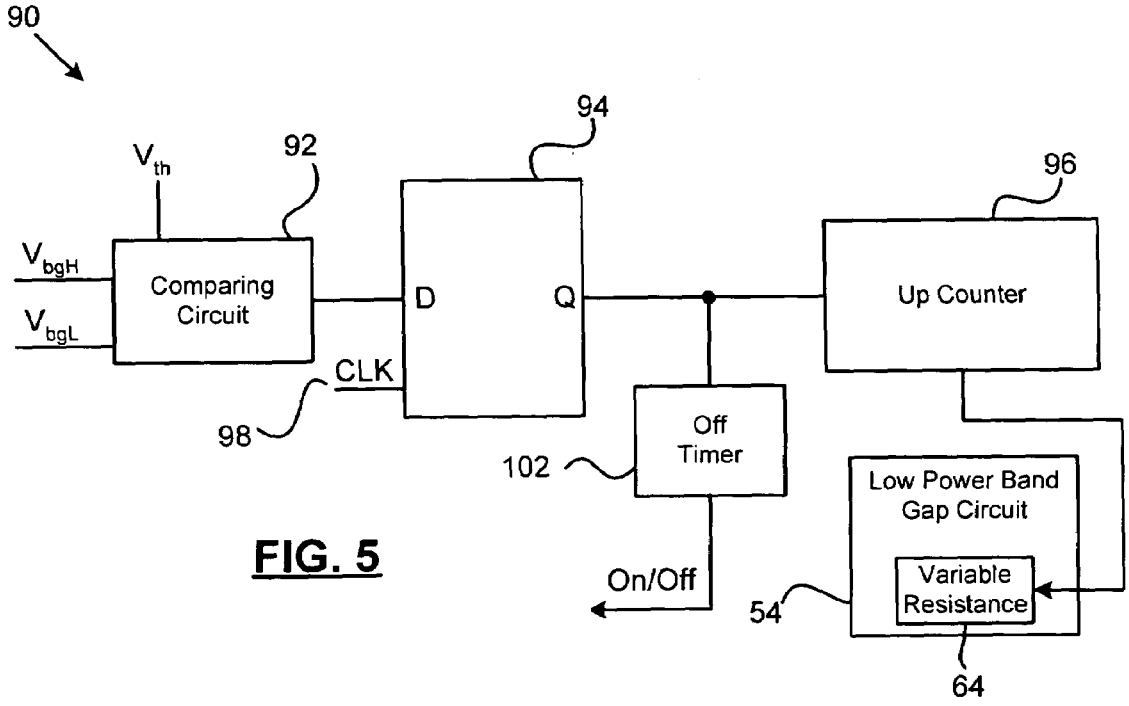
FIG. 5 illustrates an exemplary calibration circuit according to the present invention.

Referring now to FIG. 5, an exemplary calibration circuit 90 includes a comparing circuit 92, a D-type latch 94, and a counter 96. The comparing circuit 92 receives the BG voltage potential $V_{bgH}$ from the high power BG circuit 52. The comparing circuit 92 also receives the BG voltage potential $V_{bgL}$ from the low power BG circuit 54. The comparing circuit 92 determines whether the BG voltage potential $V_{bgL}$ is within a predetermined threshold $V_{th}$ of the BG voltage potential $V_{bgH}$.

In other words, the comparing circuit 92 determines whether $V_{bgH}+V_{th}>V_{bgL}>V_{bgH}-V_{th}$. For example, the threshold $V_{th}$ may be 2 mV or any other threshold. If the BG voltage potential $V_{bgL}$ is not within the threshold $V_{th}$ of the BG voltage potential $V_{bgH}$, the output of the comparing circuit 92 is a first state. If the BG voltage potential $V_{bgL}$ is within the threshold $V_{th}$ of the BG voltage potential $V_{bgH}$, the output of the comparing circuit 92 is a second state. Alternatively, a simple comparison between $V_{bgH}$ and $V_{bgL}$ may be used without the threshold $V_{th}$.

The D latch 94 receives the output from the comparing circuit 92. An output of the D latch 94 is determined by the output of the comparing circuit 92. The output of the D latch 94 is generated periodically based on a clock signal 98. If the D latch 94 receives an output of the first state from the comparing circuit 92, the D latch outputs a digital "1" at an interval determined by the clock signal 98. Conversely, if the D latch receives an output of the second state from the comparing circuit 92, the D latch outputs a digital "0" at the interval determined by the clock signal 98.

The counter 96 receives the digital "1" or "0" from the D latch. The counter 96 will receive the signal periodically as determined by the clock signal 98. The value stored by the counter 96 determines the value of a variable resistance 64 in the low power BG circuit 54. If the counter 96 receives a digital "1" from the D latch, the counter 96 increments the stored value, which increases the value of the variable resistance 64. If the counter 96 receives a digital "0", the stored value does not change.

Because the current source 66 of the BG circuit 54 is constant, adjusting the value of the variable resistance 64 also adjusts the value of the BG voltage potential $V_{bgL}$. If the BG voltage potential $V_{bgL}$ is less than the BG voltage potential $V_{bgH}$, the value of the variable resistance 64 is adjusted, thereby adjusting the BG voltage potential $V_{bgL}$.

A default value that is stored by the counter 96 ensures that the BG voltage potential $V_{bgL}$ is lower than the BG voltage potential $V_{bgH}$ at power up. Because the counter 96 is only able to increment in a positive direction, the calibration circuit 90 increases the BG voltage potential $V_{bgL}$ until it is approximately equal to the BG voltage potential $V_{bgH}$.

Calibration continues until the calibration circuit 90 determines that the BG voltage potential $V_{bgL}$ is equal to or approximately equal to the BG voltage potential $V_{bgH}$. Then, the calibration circuit 90 turns the high power BG circuit 52 off. For example, a power off timer 102 may be used to determine that the D latch 94 failed to output a digital "1" for a predetermined period. Additionally, the power off timer 102 prevents the high power BG circuit 52 from being powered off for an initial period after the power up. This ensures that the BG circuits 52 and 54 have an opportunity to stabilize.

Figure 6A:
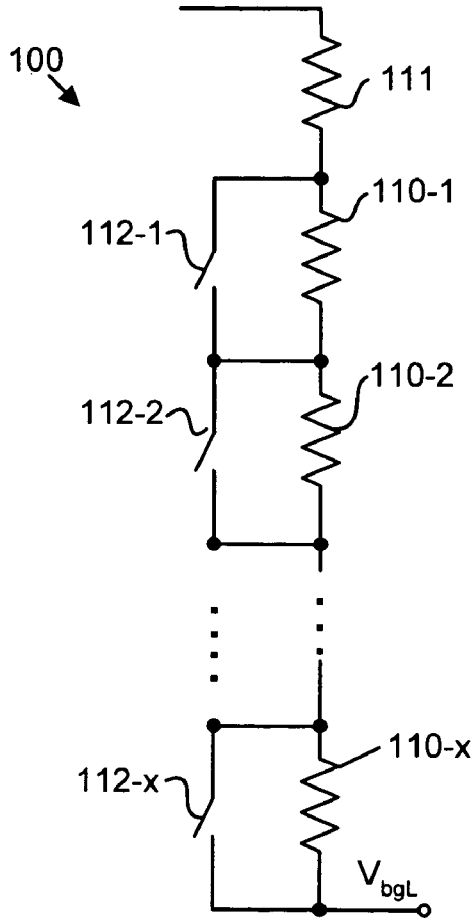
FIGS. 6A and 6B illustrate exemplary variable resistance circuits according to the present invention.
Figure 6B:
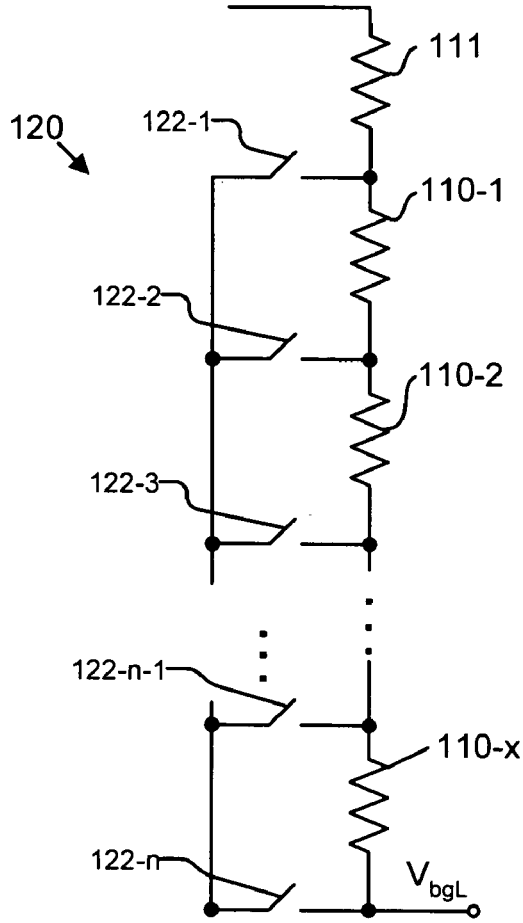

Referring now to FIGS. 6A and 6B, exemplary variable resistances are shown. In FIG. 6A, the variable resistance 100 includes multiple resistive elements 110-1, 110-2, . . . , and 110-x in series with a base resistive element 111. The resistive elements 110 and 111 can be resistors, variable resistances, or any other type of resistive circuit. The resistive elements 110 are added and/or removed using parallel switches 112-1, 112-2, . . . , and 112-x. In one embodiment, the switches 112 are transistor circuits. An output of the counter 96 in FIG. 5 is used to control the switches 112.

FIG. 6B shows another exemplary embodiment of a variable resistance 120, which includes the multiple resistive elements 110-1, 110-2, . . . , and 110-x in series with the base resistive element 111. The resistive elements 110 are added and/or removed using switches 122-1, 122-2, . . . , and 122-x. Skilled artisans will appreciate that any other device that provides a variable resistance can be used.

There are numerous methods for implementing the calibration circuit 90. For example, a down counter may be substituted for the up counter 96. In this embodiment, the calibration circuit 90 would adjust the second BG voltage reference potential $V_{bgL}$ downward from an initial value that is greater than the first BG voltage reference potential $V_{bgH}$.

Figure 7:
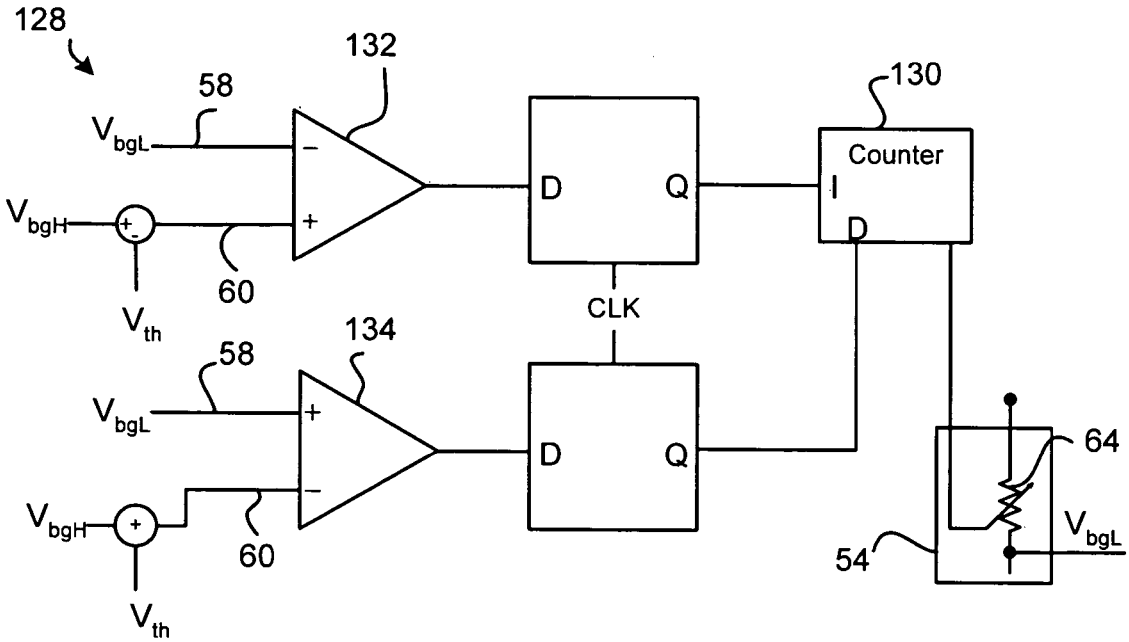
FIG. 7 illustrates a calibration circuit incorporating an up/down counter according to the present invention.

Referring now to FIG. 7, a calibration circuit 128 that includes an up/down counter 130 is shown. A first comparator 132 outputs a digital "1" if the BG voltage potential $V_{bgL}$ is less than BG voltage potential $V_{bgH}$ minus $V_{th}$. A second comparator 134 outputs a digital "1" if the BG voltage potential $V_{bgL}$ is greater than the BG voltage potential $V_{bgH}$ plus $V_{th}$. Therefore, if the BG voltage potential $V_{bgL}$ is too low, as determined by the threshold $V_{th}$, the counter 130 is incremented. If the BG voltage potential $V_{bgL}$ is too high, as determined by the threshold $V_{th}$, the counter 130 is decremented. Once the BG voltage potential $V_{bgL}$ stabilizes, the value of the counter 130 will no longer increment or decrement.

Figure 8A:
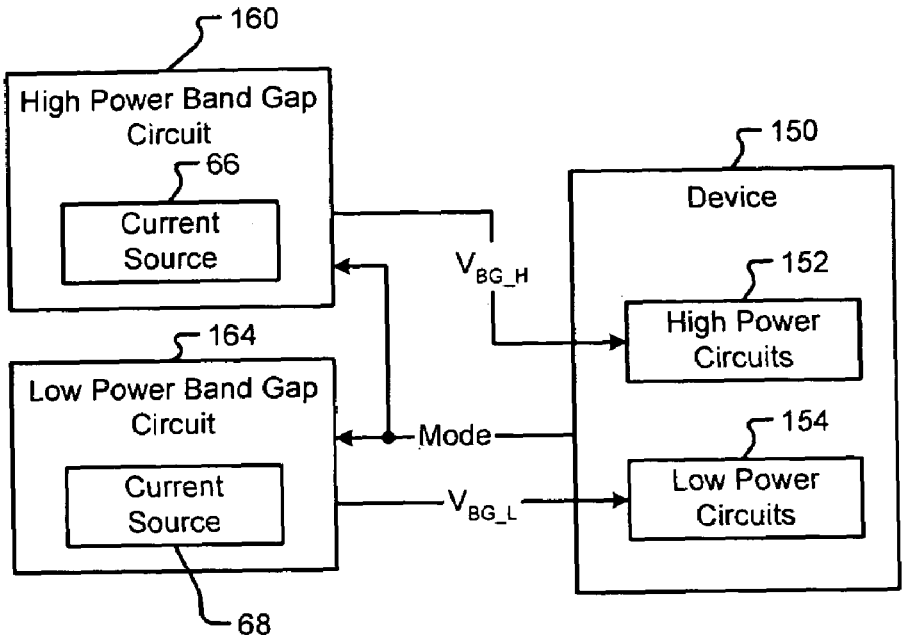
FIGS. 8A and 8B are functional block diagrams of a device including high power and low power circuits that are selectively powered by high power and low power BG circuits.

Referring now to FIG. 8A, a device 150 includes high power circuits 152 and low power circuits 154. When operating in the high power mode, the device 150 requires high power to operate the high power circuits 152. When operating in the low power mode, the device 150 requires lower power to operate the low power circuits 154. The low power circuits 154 may also be powered in both the high power and low power modes.

Figure 8B:
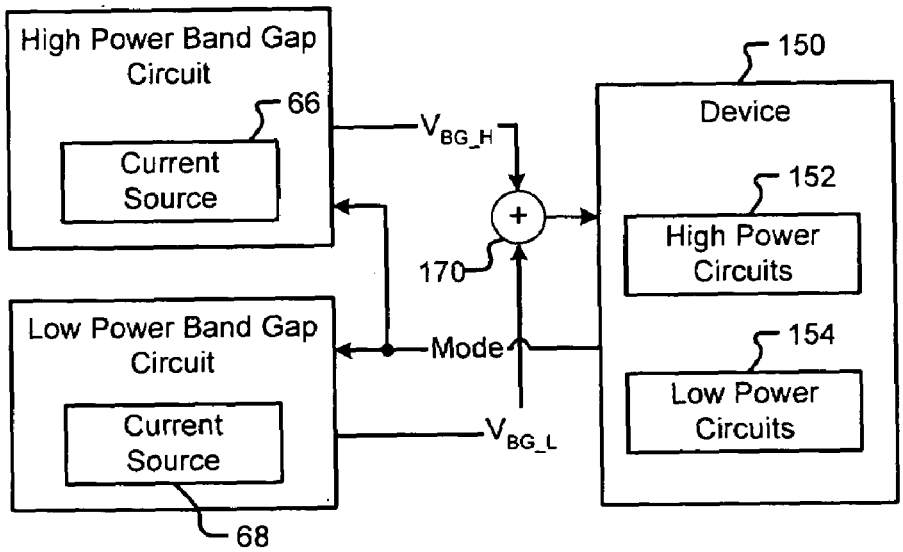

For example, the device 150 may be a transceiver that has a powered up mode and a sleep or standby mode. The device 150 generates a mode select signal that is used to turn on/off a high power BG circuit 160 and/or a low power BG circuit 164 as needed. In FIG. 8B, the BG voltage potential $V_{bgH}$ and the BG voltage potential $V_{bgL}$ are summed by a summer 170 before being input to the device 150. The device 150, in turn, distributes the supplied power to the high power circuits 152 and the low power circuits 154 as needed.

Figure 9:
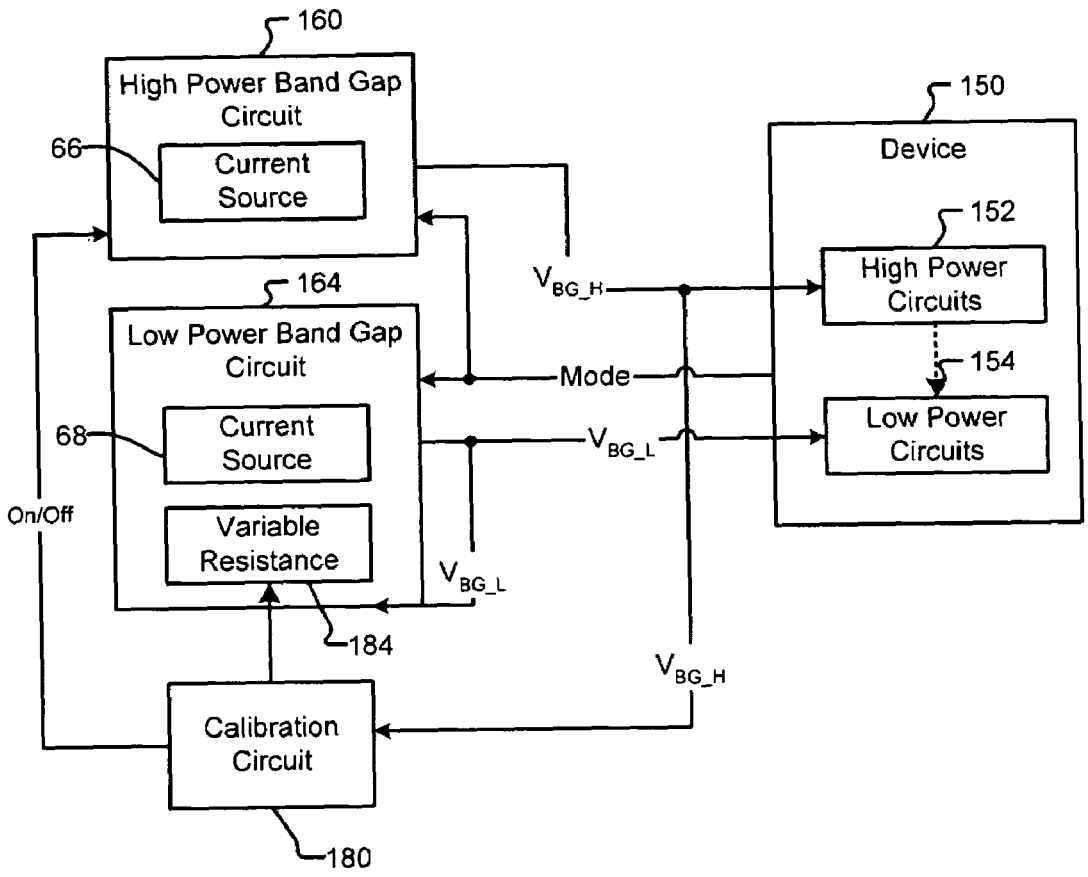
FIG. 9 is a functional block diagram of the circuits in FIG. 8A with a calibration circuit.

Referring now to FIG. 9, a calibration circuit 180 is used to calibrate the low power BG circuit 164. The low power BG circuit 164 includes a variable resistance 184 that is adjusted by the calibration circuit 180 as was described above. As can be appreciated, the circuit in FIG. 9 can also include a summer 170 as shown in FIG. 8B.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A band gap voltage reference circuit comprising:

a high accuracy band gap (BG) circuit that generates a BG voltage potential $V_{bgH}$;

a low accuracy BG circuit that includes a variable resistance and that outputs a BG voltage potential $V_{bgL}$ that is related to a value of said variable resistance, and that has a lower accuracy than said high accuracy BG circuit; and a calibration circuit that communicates with said high accuracy and low accuracy BG circuits, that adjusts said variable resistance based on a difference between said BG voltage potential $V_{bgH}$ and said BG voltage potential $V_{bgL}$, and that shuts down said high accuracy BG circuit when said BG voltage potential $V_{bgL}$ is approximately equal to said BG voltage potential $V_{bgH}$.

2. The band gap voltage reference circuit of claim 1 wherein said high accuracy BG circuit is biased by a first current level and said low accuracy BG circuit is biased by a second current level, and wherein said first current level is greater than said second current level.

3. The band gap voltage reference circuit of claim 1 wherein said calibration circuit generates a calibration signal that is used to adjust said BG voltage potential $V_{bgL}$.

4. The band gap voltage reference circuit of claim 1 wherein said calibration circuit includes a comparing circuit that compares said BG voltage potential $V_{bgH}$ to said BG voltage potential $V_{bgL}$.

5. A band gap voltage reference circuit comprising:

a high accuracy band gap (BG) circuit that generates a BG voltage potential $V_{bgH}$;

a low accuracy BG circuit that generates a BG voltage potential $V_{bgL}$; and a calibration circuit that communicates with said high accuracy and low accuracy BG circuits and that adjusts said BG voltage potential $V_{bgL}$ based on said BG voltage potential $V_{bgH}$.

6. The band gap voltage reference circuit of claim 5 wherein said high accuracy BG circuit is biased by a first current level and said low accuracy BG circuit is biased by a second current level, and wherein said first current level is greater than said second current level.

7. The band gap voltage reference circuit of claim 5 wherein said calibration circuit sets said BG voltage potential $V_{bgL}$ approximately equal to said BG voltage potential $V_{bgH}$.

8. The band gap voltage reference circuit of claim 5 wherein said calibration circuit shuts down said high accuracy BG circuit when said BG voltage potential $V_{bgL}$ is approximately equal to said BG voltage potential $V_{bgH}$.

9. The band gap voltage reference circuit of claim 5 wherein said calibration circuit generates a calibration signal that is used to adjust said BG voltage potential $V_{bgL}$.

10. The band gap voltage reference circuit of claim 9 wherein said low accuracy BG circuit includes an adjustment circuit that receives said calibration signal and that adjusts said BG voltage potential $V_{bgL}$.

11. The band gap voltage reference circuit of claim 5 wherein said calibration circuit includes a comparing circuit that compares said BG voltage potential $V_{bgH}$ to said BG voltage potential $V_{bgL}$.

12. The band gap voltage reference circuit of claim 10 wherein said adjustment circuit includes a variable resistance.

13. A band gap voltage reference circuit comprising:

a high accuracy band gap (BG) circuit that generates a BG voltage potential $V_{bgH}$;

a low accuracy BG circuit that generates a BG voltage potential $V_{bgL}$; and a device that communicates with said high and low accuracy BG circuits, that includes a high accuracy circuit and a low accuracy circuit, that operates at least one of said high accuracy circuit and said low accuracy circuit in a high accuracy mode, that operates said low accuracy circuit in a low accuracy mode, and that generates a mode signal based on said high accuracy mode and said low accuracy mode, wherein said high accuracy BG circuit turns off when said mode signal corresponds to said low accuracy mode.

14. The band gap voltage reference circuit of claim 13 wherein said low accuracy BG circuit includes a variable resistance and wherein said BG voltage potential $V_{bgL}$ is adjusted by said variable resistance.

15. The band gap voltage reference circuit of claim 14 further comprising a calibration circuit that communicates with said high accuracy and low accuracy BG circuits, that adjusts said variable resistance based on a difference between said BG voltage potential $V_{bgH}$ and said BG voltage potential $V_{bgL}$, and that shuts down said high accuracy BG circuit when said BG voltage potential $V_{bgL}$ is approximately equal to said BG voltage potential $V_{bgH}$.

16. The band gap voltage reference circuit of claim 13 wherein said high accuracy BG circuit is biased by a first current level and said low accuracy BG circuit is biased by a second current level, and wherein said first current level is greater than said second current level.

17. The band gap voltage reference circuit of claim 13 further comprising a summer that communicates with said high and low accuracy BG circuits, that sums said BG voltage potential $V_{bgL}$ and said BG voltage potential $V_{bgH}$, and that outputs said sum to said device.

18. A band gap voltage reference circuit comprising:

high accuracy band gap (BG) means for generating a BG voltage potential $V_{bgH}$;

low accuracy BG means, that includes a variable resistance means for providing a variable resistance and for generating a BG voltage potential $V_{bgL}$ based on said variable resistance means; and calibration means, that communicates with said high accuracy and low accuracy BG means, for adjusting said variable resistance based on a difference between said BG voltage potential $V_{bgH}$ and said BG voltage potential $V_{bgL}$ and for shutting down said high accuracy BG means when said BG voltage potential $V_{bgL}$ is approximately equal to said BG voltage potential $V_{bgH}$.

19. The band gap voltage reference circuit of claim 18 wherein said high accuracy BG means is biased by a first current level and said low accuracy BG means is biased by a second current level, and wherein said first current level is greater than said second current level.

20. The band gap voltage reference circuit of claim 18 wherein said calibration means generates a calibration signal that is used to adjust said BG voltage potential $V_{bgL}$.

21. The band gap voltage reference circuit of claim 18 wherein said calibration means includes comparing means for comparing said BG voltage potential $V_{bgH}$ to said BG voltage potential $V_{bgL}$.

22. A band gap voltage reference circuit, comprising:

high accuracy band gap (BG) means for generating a BG voltage potential $V_{bgH}$;

low accuracy BG means for generating a BG voltage potential $V_{bgL}$; and calibration means, that communicates with said high accuracy and low accuracy BG means, for adjusting said BG voltage potential $V_{bgL}$ based on said BG voltage potential $V_{bgH}$.

23. The band gap voltage reference circuit of claim 22 wherein said high accuracy BG means is biased by a first current level and said low accuracy BG means is biased by a second current level, and wherein said first current level is greater than said second current level.

24. The band gap voltage reference circuit of claim 23 wherein said calibration means sets said BG voltage potential $V_{bgL}$ approximately equal to said BG voltage potential $V_{bgH}$.

25. The band gap voltage reference circuit of claim 23 wherein said calibration means shuts down said high accuracy BG means when said BG voltage potential $V_{bgL}$ is approximately equal to said BG voltage potential $V_{bgH}$.

26. The band gap voltage reference circuit of claim 22 wherein said calibration means generates a calibration signal that is used to adjust said BG voltage potential $V_{bgL}$.

27. The band gap voltage reference circuit of claim 26 wherein said low accuracy BG means includes adjustment means that receives said calibration signal and that adjusts said BG voltage potential $V_{bgL}$.

28. The band gap voltage reference circuit of claim 22 wherein said calibration means includes comparing means that compares said BG voltage potential $V_{bgH}$ to said BG voltage potential $V_{bgL}$.

29. The band gap voltage reference circuit of claim 27 wherein said adjustment means includes a variable resistance.

30. A band gap voltage reference circuit, comprising:

high accuracy band gap (BG) means for generating a BG voltage potential $V_{bgH}$;

low accuracy BG means for generating a BG voltage potential $V_{bgL}$; and circuit means, that communicates with said high and low accuracy BG means and that includes a high accuracy mode and a low accuracy mode, for generating a mode signal based on said high accuracy mode and said low accuracy mode, wherein said high accuracy BG means turns off when said mode signal corresponds to said low accuracy mode.

31. The band gap voltage reference circuit of claim 30 wherein said low accuracy BG means includes variable resistance means for providing a variable resistance and wherein said BG voltage potential $V_{bgL}$ is adjusted by said variable resistance means.

32. The band gap voltage reference circuit of claim 31 further comprising calibration means, that communicates with said high accuracy and low accuracy BG means, for adjusting said variable resistance means based on a difference between said BG voltage potential $V_{bgH}$ and said BG voltage potential $V_{bgL}$, and for shutting down said high accuracy BG means when said BG voltage potential $V_{bgL}$ is approximately equal to said BG voltage potential $V_{bgH}$.

33. The band gap voltage reference circuit of claim 30 wherein said high accuracy BG means is biased by a first current level and said low accuracy BG means is biased by a second current level, and wherein said first current level is greater than said second current level.

34. The band gap voltage reference circuit of claim 30 further comprising summing means, that communicates with said high and low accuracy BG means, for summing said BG voltage potential $V_{bgL}$ and said BG voltage potential $V_{bgH}$, and for outputting said sum to said circuit means.

35. A method for generating a band gap voltage reference, comprising:

generating a BG voltage potential $V_{bgH}$ using a high accuracy BG circuit;

generating a BG voltage potential $V_{bgL}$ using a low accuracy BG circuit that includes a variable resistance, wherein said BG voltage potential $V_{bgL}$ is related to said variable resistance;

adjusting said variable resistance based on a difference between said BG voltage potential $V_{bgH}$ and said BG voltage potential $V_{bgL}$; and shutting down said high accuracy BG circuit when said BG voltage potential $V_{bgL}$ is approximately equal to said BG voltage potential $V_{bgH}$.

36. The method of claim 35 further comprising:

biasing said high accuracy BG circuit with a first current level; and biasing said low accuracy BG circuit with a second current level, wherein said first current level is greater than said second current level.

37. The method of claim 35 further comprising generating a calibration signal that is used to adjust said BG voltage potential $V_{bgL}$.

38. The method of claim 35 further comprising comparing said BG voltage potential $V_{bgH}$ to said BG voltage potential $V_{bgL}$.

39. A method for providing a band gap voltage reference, comprising:

generating a BG voltage potential $V_{bgH}$ using a high accuracy band gap (BG) circuit;

generating a BG voltage potential $V_{bgL}$ using a low accuracy BG circuit; and adjusting said BG voltage potential $V_{bgL}$ based on said BG voltage potential $V_{bgH}$.

40. The method of claim 39 further comprising:

biasing said high accuracy BG circuit with a first current level; and biasing said low accuracy BG circuit with a second current level, wherein said first current level is greater than said second current level.

41. The method of claim 40 further comprising setting said BG voltage potential $V_{bgL}$ approximately equal to said BG voltage potential $V_{bgH}$.

42. The method of claim 40 further comprising shutting down said high accuracy BG circuit when said BG voltage potential $V_{bgL}$ is approximately equal to said BG voltage potential $V_{bgH}$.

43. The method of claim 39 further comprising generating a calibration signal that is used to adjust said BG voltage potential $V_{bgL}$.

44. A method for generating a band gap voltage reference, comprising:

generating a BG voltage potential $V_{bgH}$ using a high accuracy band gap (BG) circuit;

generating a BG voltage potential $V_{bgL}$ using a low accuracy BG circuit;

providing a device having a high accuracy mode and a low accuracy mode;

generating a mode signal using said device based on said high accuracy mode and said low accuracy mode; and turning off said high accuracy BG circuit when said mode signal corresponds to said low accuracy mode.

45. The method of claim 44 wherein said low accuracy BG means includes a variable resistance and wherein said BG voltage potential $V_{bgL}$ is related to said variable resistance.

46. The method of claim 45 further comprising:

adjusting said variable resistance based on a difference between said BG voltage potential $V_{bgH}$ and said BG voltage potential $V_{bgL}$; and shutting down said high accuracy BG circuit when said BG voltage potential $V_{bgL}$ is approximately equal to said BG voltage potential $V_{bgH}$.

47. The method of claim 44 further comprising:

biasing said high accuracy BG circuit with a first current level;

biasing said low accuracy BG circuit with a second current level, wherein said first current level is greater than said second current.

48. The method of claim 44 further comprising:

summing said BG voltage potential $V_{bgL}$ and said BG voltage potential $V_{bgH}$; and outputting said sum to said device.

49. A band gap voltage reference circuit comprising:

a first band gap (BG) circuit that generates a first BG voltage potential;

a second BG circuit that includes a variable resistance, that outputs a second BG voltage potential that is related to a value of said variable resistance; and a calibration circuit that communicates with said first and second BG circuits, that adjusts said variable resistance based on a difference between said first BG voltage potential and said second BG voltage potential, and that shuts down said first BG circuit when said second BG voltage potential is approximately equal to said first BG voltage potential.

50. The band gap voltage reference circuit of claim 49 wherein said first BG circuit is biased by a first current level and said second BG circuit is biased by a second current level, and wherein said first current level is greater than said second current level.

51. The band gap voltage reference circuit of claim 49 wherein said calibration circuit generates a calibration signal that is used to adjust said second BG voltage potential.

52. The band gap voltage reference circuit of claim 49 wherein said calibration circuit includes a comparing circuit that compares said first BG voltage potential to said second BG voltage potential.

53. A band gap voltage reference circuit comprising:

a first band gap (BG) circuit that generates a first BG voltage potential;

a second BG circuit that generates a second BG voltage potential; and a calibration circuit that communicates with said first and second BG circuits and that adjusts said second BG voltage potential based on said first BG voltage potential.

54. The band gap voltage reference circuit of claim 53 wherein said first BG circuit is biased by a first current level and said second BG circuit is biased by a second current level, and wherein said first current level is greater than said second current level.

55. The band gap voltage reference circuit of claim 53 wherein said calibration circuit sets said second BG voltage potential approximately equal to said first BG voltage potential.

56. The band gap voltage reference circuit of claim 53 wherein said calibration circuit shuts down said first BG circuit when said second BG voltage potential is approximately equal to said first BG voltage potential.

57. The band gap voltage reference circuit of claim 53 wherein said calibration circuit generates a calibration signal that is used to adjust said second BG voltage potential.

58. The band gap voltage reference circuit of claim 57 wherein said second BG circuit includes an adjustment circuit that receives said calibration signal and that adjusts said second BG voltage potential.

59. The band gap voltage reference circuit of claim 53 wherein said calibration circuit includes a comparing circuit that compares said first BG voltage potential to said second BG voltage potential.

60. The band gap voltage reference circuit of claim 58 wherein said adjustment circuit includes a variable resistance.

61. A band gap voltage reference circuit comprising:

a first band gap (BG) circuit that generates a first BG voltage potential;

a second BG circuit that generates a second BG voltage potential; and a device that communicates with said first and second BG circuits, that includes a first circuit and a second circuit, that operates at least one of said first circuit and said second circuit in a first mode, that operates said second circuit in a second mode, and that generates a mode signal based on said first mode and said second mode, wherein said first BG circuit turns off when said mode signal corresponds to said second mode.

62. The band gap voltage reference circuit of claim 61 wherein said second BG circuit includes a variable resistance and wherein said second BG voltage potential is adjusted by said variable resistance.

63. The band gap voltage reference circuit of claim 62 further comprising a calibration circuit that communicates with said first and second BG circuits, that adjusts said variable resistance based on a difference between said first BG voltage potential and said second BG voltage potential, and that shuts down said first BG circuit when said second BG voltage potential is approximately equal to said first BG voltage potential.

64. The band gap voltage reference circuit of claim 61 wherein said first BG circuit is biased by a first current level and said second BG circuit is biased by a second current level, and wherein said first current level is greater than said second current level.

65. The band gap voltage reference circuit of claim 61 further comprising a summer that communicates with said first and second BG circuits, that sums said second BG voltage potential and said first BG voltage potential, and that outputs said sum to said device.

66. A band gap voltage reference circuit comprising:

first band gap (BG) means for generating a first BG voltage potential;

second BG means, that includes a variable resistance means for providing a variable resistance, for generating a second BG voltage potential based on said variable resistance means; and calibration means, that communicates with said first and second BG means, for adjusting said variable resistance based on a difference between said first BG voltage potential and said second BG voltage potential and for shutting down said first BG means when said second BG voltage potential is approximately equal to said first BG voltage potential.

67. The band gap voltage reference circuit of claim 66 wherein said first BG means is biased by a first current level and said second BG means is biased by a second current level, and wherein said first current level is greater than said second current level.

68. The band gap voltage reference circuit of claim 66 wherein said calibration means generates a calibration signal that is used to adjust said second BG voltage potential.

69. The band gap voltage reference circuit of claim 66 wherein said calibration means includes comparing means for comparing said first BG voltage potential to said second BG voltage potential.

70. A band gap voltage reference circuit, comprising:

first band gap (BG) means for generating a first BG voltage potential;

second BG means for generating a second BG voltage potential; and calibration means, that communicates with said first and second BG means, for adjusting said second BG voltage potential based on said first BG voltage potential.

71. The band gap voltage reference circuit of claim 70 wherein said first BG means is biased by a first current level and said second BG means is biased by a second current level, and wherein said first current level is greater than said second current level.

72. The band gap voltage reference circuit of claim 71 wherein said calibration means sets said second BG voltage potential approximately equal to said first BG voltage potential.

73. The band gap voltage reference circuit of claim 71 wherein said calibration means shuts down said first BG means when said second BG voltage potential is approximately equal to said first BG voltage potential.

74. The band gap voltage reference circuit of claim 70 wherein said calibration means generates a calibration signal that is used to adjust said second BG voltage potential.

75. The band gap voltage reference circuit of claim 74 wherein said second BG means includes adjustment means for receiving said calibration signal and for adjusting said second BG voltage potential.

76. The band gap voltage reference circuit of claim 70 wherein said calibration means includes comparing means for comparing said first BG voltage potential to said second BG voltage potential.

77. The band gap voltage reference circuit of claim 75 wherein said adjustment means includes a variable resistance.

78. A band gap voltage reference circuit, comprising:

first band gap (BG) means for generating a first BG voltage potential;

second BG means for generating a second BG voltage potential; and circuit means, that communicates with said first and second BG means and that includes a first mode and a second mode, for generating a mode signal based on said first mode and said second mode, wherein said first BG means turns off when said mode signal corresponds to said second mode.

79. The band gap voltage reference circuit of claim 78 wherein said second BG means includes variable resistance means for providing a variable resistance and wherein said second BG voltage potential is adjusted by said variable resistance means.

80. The band gap voltage reference circuit of claim 79 further comprising calibration means, that communicates with said first and second BG means, for adjusting said variable resistance means based on a difference between said first BG voltage potential and said second BG voltage potential, and for shutting down said first BG means when said second BG voltage potential is approximately equal to said first BG voltage potential.

81. The band gap voltage reference circuit of claim 78 wherein said first BG means is biased by a first current level and said second BG means is biased by a second current level, and wherein said first current level is greater than said second current level.

82. The band gap voltage reference circuit of claim 78 further comprising summing means, that communicates with said first and second BG means, for summing said second BG voltage potential and said first BG voltage potential, and for outputting said sum to said circuit means.

83. A method for generating a band gap voltage reference, comprising:

generating a first BG voltage potential using a first BG circuit;

generating a second BG voltage potential using a second BG circuit that includes a variable resistance, wherein said second BG voltage potential is related to said variable resistance, adjusting said variable resistance based on a difference between said first BG voltage potential and said second BG voltage potential; and shutting down said first BG circuit when said second BG voltage potential is approximately equal to said first BG voltage potential.

84. The method of claim 83 further comprising:

biasing said first BG circuit with a first current level; and biasing said second BG circuit with a second current level, wherein said first current level is greater than said second current level.

85. The method of claim 83 further comprising generating a calibration signal that is used to adjust said second BG voltage potential.

86. The method of claim 83 further comprising comparing said first BG voltage potential to said second BG voltage potential.

87. A method for providing a band gap voltage reference, comprising:

generating a first BG voltage potential using a first band gap (BG) circuit;

generating a second BG voltage potential using a second BG circuit; and adjusting said second BG voltage potential based on said first BG voltage potential.

88. The method of claim 87 further comprising:

biasing said first BG circuit with a first current level; and biasing said second BG circuit with a second current level, wherein said first current level is greater than said second current level.

89. The method of claim 88 further comprising setting said second BG voltage potential approximately equal to said first BG voltage potential.

90. The method of claim 88 further comprising shutting down said first BG circuit when said second BG voltage potential is approximately equal to said first BG voltage potential.

91. The method of claim 87 further comprising generating a calibration signal that is used to adjust said second BG voltage potential.

92. A method for generating a band gap voltage reference, comprising:

generating a first BG voltage potential using a first band gap (BG) circuit;

generating a second BG voltage potential using a second BG circuit;

providing a device having a first mode and a second mode;

generating a mode signal using said device based on said first mode and said second mode; and turning off said first BG circuit when said mode signal corresponds to said second mode.

93. The method of claim 92 wherein said second BG circuit includes a variable resistance and wherein said second BG voltage potential is related to said variable resistance.

94. The method of claim 93 further comprising:

adjusting said variable resistance based on a difference between said first BG voltage potential and said second BG voltage potential; and shutting down said first BG circuit when said second BG voltage potential is approximately equal to said first BG voltage potential.

95. The method of claim 92 further comprising:

biasing said first BG circuit with a first current level;

biasing said second BG circuit with a second current level, wherein said first current level is greater than said second current.

96. The method of claim 92 further comprising:

summing said second BG voltage potential and said first BG voltage potential; and outputting said sum to said device.

* * * * *

UNITED STATES PATENT AND TRADEMARK OFFICE

CERTIFICATE OF CORRECTION

PATENT NO. : 7,023,194 B1
APPLICATION NO. : 10/926185
DATED : April 4, 2006
INVENTOR(S) : Sehat Sutardja et al.

It is certified that error appears in the above-identified patent and that said Letters Patent is hereby corrected as shown below:

Column 4, Line 35: Delete “a” after “at”

Signed and Sealed this

Sixth Day of March, 2007

JON W. DUDAS
*Director of the United States Patent and Trademark Office*